US007513021B1

(12) United States Patent
Haselwander

(10) Patent No.: US 7,513,021 B1
(45) Date of Patent: Apr. 7, 2009

(54) VARIABLE CORING OF TWISTED YARN

(76) Inventor: John G. Haselwander, 726 Morning Shadows Dr., Chattanooga, TN (US) 37421

( * ) Notice: Subject to any disclaimer, the term of this patent is extended or adjusted under 35 U.S.C. 154(b) by 0 days.

(21) Appl. No.: 12/039,161

(22) Filed: Feb. 28, 2008

(51) Int. Cl.
*D02G 1/02* (2006.01)
*D02G 1/16* (2006.01)
*D01H 13/00* (2006.01)

(52) U.S. Cl. ..... 28/248; 28/247; 28/252; 57/264

(58) Field of Classification Search ..... 28/252, 28/248, 247, 219, 271, 272, 281; 57/264, 57/75, 58.3, 58.49, 293, 204, 205, 59, 66, 57/244, 3, 6, 10–12, 332, 333, 350, 362, 57/206–209, 908
See application file for complete search history.

(56) References Cited

U.S. PATENT DOCUMENTS 2,933,881 A * 4/1960 Lloyd ..... 57/93
3,703,753 A * 11/1972 Binford et al. ..... 28/220
4,034,544 A * 7/1977 Clarkson ..... 57/290
4,155,216 A * 5/1979 Griset, Jr. ..... 28/271
4,569,192 A * 2/1986 Yamada et al. ..... 57/264
4,590,754 A * 5/1986 Bouffard et al. ..... 57/58.55
4,606,181 A * 8/1986 Lappage et al. ..... 57/58.38
4,790,132 A * 12/1988 Nelson ..... 57/284
5,706,642 A * 1/1998 Haselwander ..... 57/264
5,901,544 A * 5/1999 McNeill ..... 28/252
6,012,277 A * 1/2000 Prins et al. ..... 57/315
6,023,926 A * 2/2000 Flynn ..... 57/210
6,601,378 B1 * 8/2003 Fritsch et al. ..... 57/238

* cited by examiner

*Primary Examiner*—Amy B Vanatta
(74) *Attorney, Agent, or Firm*—Stephen J. Stark; Miller & Martin PLLC

(57) ABSTRACT

A method and apparatus for entangling two or more strands of yarn together in accordance with a pre-selected and changeable pattern so as to obtain twisted yarn with a selected coring level extending for a selected length of the yarn and other selected coring levels extending for various other lengths of the yarn so that a supply such as a package of finished yarn has a variable coring pattern which may be reproducible and possibly changeable.

18 Claims, 3 Drawing Sheets

VARIABLE CORING OF TWISTED YARN

BACKGROUND OF THE INVENTION

1. Field of the Invention

This invention relates to twisting of yarn or threads while selectively coring at least one of the strands relative to another and more particularly to twisting while coring at least two separate yarns or thread strands in accordance with a selected pattern.

2. Description of Related Art

In the art of twisting yarn and thread, hereinafter together referred to yarn twisting, a pre-determined twist level is normally selected and usually remains constant for a particular finished yarn. Twist level is defined as the turns of twist or wrap of the yarn or thread about each other for a given segment of length of the twisted yarn or thread. The twisting of yarn comprises twisting at least one strand or ply of yarn together or about another such that there is a pre-determined number of turns of yarn twisted with or wrapped about another yarn.

Various entanglers including twisters employing twisting techniques are utilized in the art to obtain a twisted multiple ply yarn product. For example, ring twisting wherein strands of yarn pass through a ring and are twisted as the ring rotates about a rotating bobbin on which the yarn is wound; two-for-one twisting wherein two bobbins of yarn are combined within a common can, pass through the center of a rotating yarn twister spindle and out a radial hole; and cabling wherein one or more yarn strands enter the bottom of a rotating twister spindle at the center and exit through a radial hole and enters an eyelet or ring to form a balloon which throws out about a supply bobbin of another yarn with which it is twisted, are three such methods for twisting yarn strands together or one or more yarns twisted about another yarn with various twisters.

In each method it is the general practice to maintain the twist level or number of turns per inch of the yarn constant. Twisters that perform these methods often include a common drive motor, and the ratio between the yarn speed and the final yarn package speed, which determines the twist level, is obtained by the use of change twist gears. Thus, the twist level of a particular yarn is constant and is monitored to remain constant. In order to change twist level, different change twist gears are utilized, but this is usually only done for one twisted yarn at a time, i.e., a single yarn has only one twist level.

It has been found that if the twist level of a given yarn may be varied along its length, products made from such yarn, such as carpet, may have unusual aesthetic styling. In the prior art, an attempt to obtain twist variation along the length of the yarn was proposed in Lloyd U.S. Pat. No. 2,933,881, which utilizes a variable speed device wherein the output speed is controlled by a control lever either moved by a cam or manually moved to change the speed of the yarn take-up spool to vary the twist of the yarn within the final package.

In Yamada et al U.S. Pat. No. 4,569,192 single strand spun yarns wherein the fibers are spun, drafted and twisted, it was proposed to vary the twist and drafting of the strand while the spun yarn strand is being formed in yarn spinning equipment.

U.S. Pat. No. 5,706,642 provided a system for forming a twisted yarn having multiple plies of yarn which eliminates the need for changing gears, cams or other mechanical or manual devices and which permits large twist pattern variations in the product such that the length of the segments of a desired twist level may be varied along with the twist level. Such yarn can be utilized for forming carpet or other textiles with unique and different patterns and aesthetics. Accordingly, the '642 patent provides a desirable system and method whereby variations in yarn twist level may be selectively made and wherein wide variations may be selected when twisting multiple strands of yarn together into a composite twisted yarn.

While varying twist level is certainly one way to produce unique and different patterns of yarn, such as is taught and disclosed in the '642 patent, the applicant is unaware of any attempt to purposefully vary coring level in yarn segments provided to a yarn package. In fact, many twisting systems are believed to include careful feeding mechanisms to the twister which effectively equalize the tension on all individual strands of yarn or threads so that the lengths are equal in length when twisted, and thus no coring occurs (or coring level=0).

U.S. Pat. No. 7,051,517 shows that when making a cabled tire cord, coring one yarn relative to another a predetermined amount can result in a hybrid cord with an unbalanced configuration (i.e., at least yarns have different lengths when unwound—the coring level is not equal to zero). Coring level is normally obtained by taking a sample of one meter of cabled cord and untwisting the cable in order to separate the component yarns. The length of yarns A and B (if only two yarns are present) are then compared and the coring level can be calculated as Coring level=(A−B)/A.

In the teaching of the '517 patent, it was found that the hybrid cord has a greater tensile strength retention than a balanced configuration (Coring level=0). Furthermore, once the optimized tensile strength is discovered, the '517 patent teaches: Keeping the hybrid cord at that coring level "Once the coring level for a given pair of yarns is optimized and defined for a given end use, one may contemplate as another method permanent machine modifications in order to restrict coring to that optimized level." (Col. 5, lines 11-15). Accordingly, the '517 patent would appear to teach away from varying the coring level in a cabled cord product.

Even with the improvements provided over other prior art as provided by the '642 patent as it relates to varying twist level, the applicant believes that an unmet need still exists for creating other unique and different patterns with or without varying the twist level when twisting multiple strands of yarn together into a composite twisted yarn. Accordingly, a need exists for a system for forming twisted yarn having multiple plies of yarn which can impart pattern variation in the product in a new manner.

SUMMARY OF THE INVENTION

Consequently, it is an object of a presently preferred embodiment of the present invention to provide a method and apparatus for twisting or otherwise entangling two or more strands of yarn into an entangled or twisted yarn while varying the coring level along selected lengths of the entangled yarn.

It is another object of at least one embodiment of the present invention to provide a method and apparatus for entangling and/or twisting two or more yarn strands together in accordance with a selective coring pattern and for changing the pattern selectively.

It is a further object of at least one embodiment of the present invention to provide in yarn twisting or entangling apparatus a method and apparatus for selectively controlling the tension of at least one yarn forming a yarn package to selectively core at least one yarn relative to another for at least two segments provided to the yarn package.

Accordingly, a presently preferred embodiment of the present invention provides a method and apparatus for entangling and/or twisting two or more strands of yarn together in accordance with a pre-selected and/or changeable pattern so as to obtain twisted and/or entangled yarn with a selective coring level extending for a selective length of the twisted yarn and other selective coring levels extending for various selective lengths of the twisted and/or entangled yarn so that the twisted and/or entangled yarn on a product package or spool has a variable coring pattern, i.e., a selected coring level for selected segments of the yarn, the coring pattern possibly being reproducible and changeable. Furthermore, in another embodiment of the present invention, a yarn package is produced using an embodiment resulting in a yarn package having at least two different coring levels along two segments.

To this end, the present invention provides an entangler such as a twister such as a yarn twisting apparatus which may have a first driver which rotates a finished package of plural strands of yarn twisted together, a second driver which may be usefully in operating the yarn twister means, and at least one selectively operable tension applicator which acts on at least one yarn strand while twisting yarns together to impart selectable core leveling at least two segments of the twisted yarn package. In some embodiments, it is envisioned that a controller possibly having a controllable driver with a controllable tension applicator may be provided as the first and/or second driver, and/or a programmable controller provided which may control the coring level along portions of the yarn package which could be based on the time and/or distance that selective tension is maintained on a particular yarn. Furthermore, more than one tension applicator may utilized with two or more yarn strands which can give rise to a range of coring possibilities over one or more yarn packages. Although a twister is one entangling device, air entanglement, air twist and/or reverse twist machines are also contemplated as entanglers.

In accordance with at least one embodiment of the invention various patterns may be stored in a storage device, processing device and/or controller which may at least assist in controlling the final pattern of the yarn and can be programmed in at least some embodiments to make various patterns. Changing from one pattern to another may, or may not, merely involve accessing a particular pattern from stored information in a device such as the processing device in some embodiments.

The first and second drivers may, or may not, comprise a motor controlled by a programmable controller which can drive the respective motor at precise speeds for precise times to change the speed ratios in accordance with a pattern in some embodiments. The at least one tension applicator preferably has an ability to selectively apply more than one preselected tension based on a pattern.

The principles of the present invention may be applied to any of the known yarn twisting methods with various entangler and/or twister constructions. For example, an entangler with at least one tension applicator may be applied readily to the cabling method, the two for one twisting or ring twisting methods merely by utilizing a tension applicator which may have a preselected tension applied and/or released while twisting the yarn package. Air entanglement equipment and/or air twist/twist reverse equipment may also be included within the scope of an "entangler." A controller with a tension feedback may assist in controlling the tension. A selected coring level or ratio may be provided at selected times and/or lengths to produce selectively cored segments. In this manner the coring level may be selected for selected segments of the finished yarn such as could be provided in accordance with a pattern provided by the controller.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
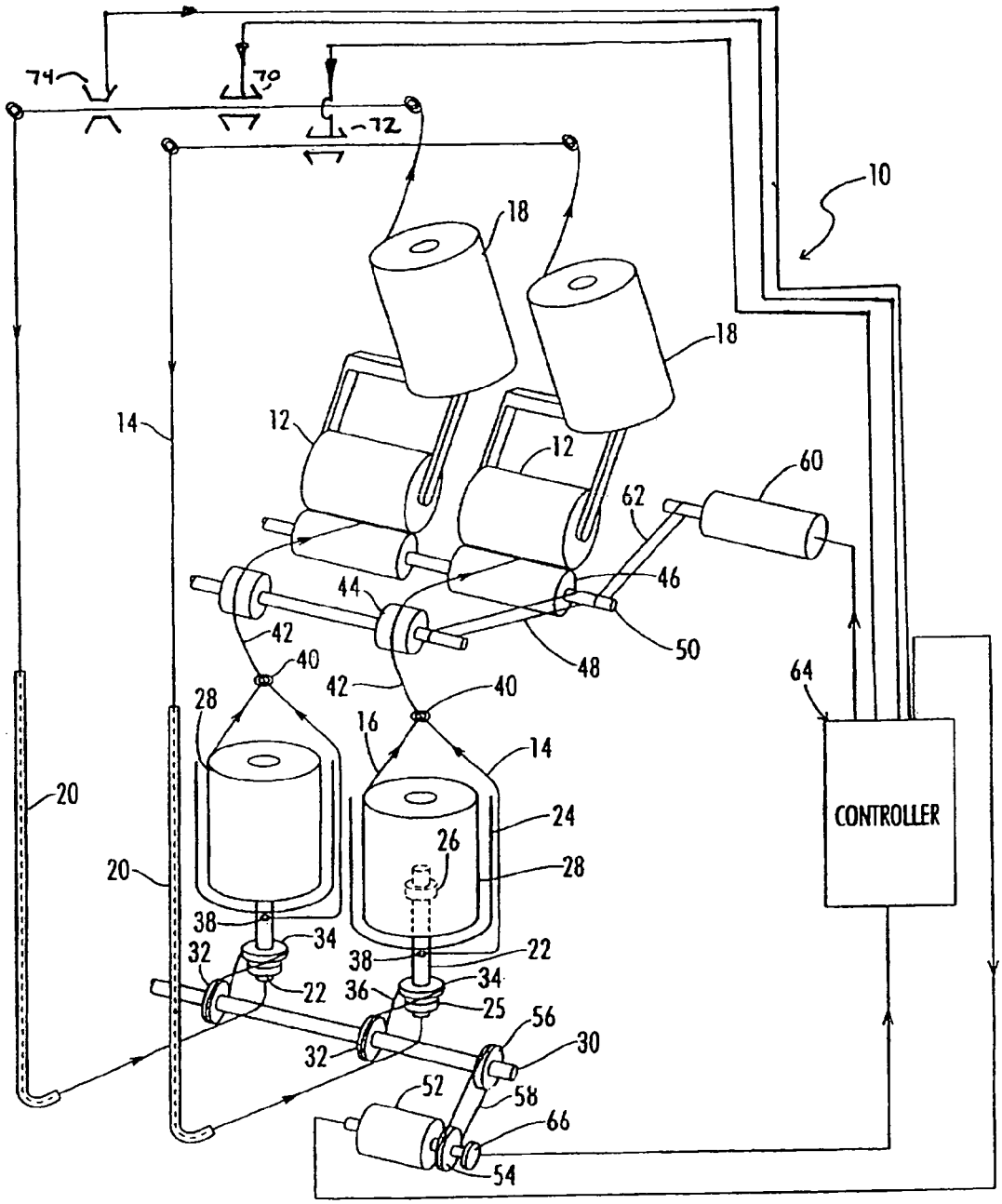
FIG. 1 is a diagrammatic view illustrating an apparatus for a cabling method of twisting two yarn strands together into a twisted yarn product and having patterning apparatus constructed in accordance with the principles of a present embodiment of the present invention.

Referring now to the drawings, FIG. 1 illustrates an embodiment of a multiple yarn package cabling type twisting apparatus or system illustrated in the form of station 10 for twisting two yarns into product packages 12 of twisted yarn. Although only two stations of packages 12 are illustrated, it should be understood that a yarn twisting facility may have many such stations 10 being formed simultaneously, one hundred such stations not being uncommon. Additionally, although FIG. 1 illustrates the twisting of two yarn strands 14, 16, which is a typical situation, three or more such yarns may be twisted together at one station by a single twister without departing from the present invention.

An entangler such as twister 15 of a presently preferred embodiment is shown in FIG. 1. One of the strands 14 is illustrated drawn from a supply package 18 conventionally mounted overhead on a creel (not illustrated) and is fed through a guide tube 20 into a bore at the lower end of the spindle 22 which may rotate within a bearing 25 which extends into a can or bucket 24. A bearing assembly 26 adjacent the upper end of the spindle 22 within the can support the core of a second supply yarn package 28 to prevent rotation of the package 28. Rotation of all the spindles 22 at the multiplicity of stations may be derived from a drive shaft 30 on which a pulley 32 corresponding to each spindle 22 and package 28 is mounted. A pulley 34 having an associated clutch (not illustrated) corresponding to each pulley 32 may be mounted on a respective spindle 22 and is driven by a belt 36 trained about the pulleys 32, 34 when the clutch is engaged. The clutch may be disengaged to uncouple the respective spindle 22 to the drive shaft 30 for changing the package from one of twisters without shutting down the other twisters.

The yarn strand 14 entering the bore at each spindle 22 is shown exiting the bore through a hole 38 disposed in the surface of the spindle, balloons out about the can 24 and is drawn up through a pigtail or ring 40 above the package 28 where it is twisted together with the yarn strand 16 drawn off from the package 28 to form the twisted composite yarn 42. The twisted yarn 42 may then be fed to the respective product package 12 by means of a yarn pre-feed roll 44 and a package take-up roll 46 which conventionally engages and drives the package 12, the pre-feed roll being driven by a drive connection 48 from the shaft 50 of the package take-up roll 46.

The number of turns or twist of yarn per minute may be derived from the speed of the spindle 22, or yarn twist speed, and thus the drive shaft 30, while the turn per inch of yarn or twist level in the yarn package is derived from the differential or ratio between the speed of the drive shaft 30 and the speed of the yarn package, i.e., the speed of the take-up roll 46. Conventionally, the ratio of these speeds is fixed—a motor and drive coupling drives the shaft 30 and the ratio between the yarn speed and the final package take-up speeds are determined and fixed by use normally by gearing. Such a construction could be the case in many embodiments.

A second driver is illustrated as a main motor 52 driving the shaft 30 via pulleys 54, 56 mounted on the motor 52 and the shaft 30 respectively with a belt or the like 58 trained about the pulleys. The motor 52 can act as a master as hereinafter explained. A first driver illustrated as a separate motor 60 may be utilized to drive one or more of the package take-up rolls 46 through coupling means 62, the motor 60 acting as a slave motor as hereinafter explained. If desired, and may be a requirement when tension is critical between the pre-feed rolls 44 and package take-up roll 46, a separate motor (not illustrated), which is also a slave motor, may drive the pre-feed rollers 44. The motors may be connected to a programmable motor controller 64 for controlling the speed of the motor 60 and a pre-feed roll motor if used, in response to a pattern programmed into the controller and in response to the speed of the main motor 52 so as to set the twist level. The main motor preferably includes a tachometer 66 for providing feed-back information to the controller 64.

The motors 52 and 60 may be servo motors or may be a.c. motors, and the motor controller 64, which may be a conventional microprocessor based programmable industrial controller, is selected to be compatible. The pattern setting means for the motor controller 64 may comprise information as to the speed ratio between the main shaft 52 and the package take-up roller motor 60 and the time this ratio is to be held. The pattern may be as long as desirable with as many segments of different twist levels as desired and practicable within the limits of the controller selected.

While yarn twist level has been adjusted in the prior art with the technology shown and described in U.S. Pat. No. 5,706,642 and above or with other structure, no effort is known by the applicant to have been implemented to provide for the selective adjustment of coring level for a particular yarn package 12. Specifically one or more tension applicators 70,72 are illustrated in FIG. 1 which may be provided for at least one, if not up to all of the yarn strands 14,16 provided to one or more entanglers such as twisters 15. Controller 64, in addition to possibly controlling twist level in some embodiments or a different controller, can be utilized to provide at least signals to tension applicators 70,72 which can impart and/or release a predetermined amount of tension on strand 14 relative to strand 16 to selectively core one of yarn 14,16 relative to the other of yarn 14,16. Controllers 64 may be mechanical, electro-mechanical or otherwise provided depending on the particular embodiment.

Tension applicators 70,72 could take a variety of forms as are known in the art, including but not limited to air pressure to assist, such as may be provided to resilient members to apply a pressure against an adjacent yarn, spring disc tension devices, alligator type tension devices, S-bar tensioners bullet tension devices and/or others. It is envisioned with the presently preferred embodiment that controller 64 initiates a command to change an amount of tension provided by a tension applicator 70,72. After coring at least one yarn relative to another with a coring level not equal to zero for a first predetermined length and/or time, a different coring level, including a coring level of zero or not zero, is then preferably provided for a second predetermined length and/or time. At least two coring levels are provided to the yarn package 12 in accordance with a pattern. It is envisioned in many embodiments that twist level will be constant.

Although the embodiment of FIG. 1 shows just two yarn strands 14, 16 forming an entangled and/or twisted yarn provided to package 12, more than two yarn strands can be provided. Additionally, the length and/or time for which a particular coring level is maintained could vary such as for one inch, one thousand inches or more, twenty inches, etc. A patterned yarn provided to the package 12 could be provided such as of two plies or more. Varying the number of different color variations possible can vary significantly depending upon the number of plies and the amount of tensions applied to any particular one or more of the plies. Examples are provided below for a three ply yarn twisted and provided to a yarn package 12.

1. A red yarn strand provided at a tension of 60 grams. White yarn strand provided at a tension of 30 grams and blue yarn strand provided at a tension of 10 grams. The eye might see a three ply yarn that is predominantly blue with red showing up the least.

2. A red yarn strand provided at a tension of 30 grams. White yarn strand provided at a tension of 10 grams and blue yarn strand provided at a tension of 60 grams. The eye might see a three ply yarn that is predominantly white with blue showing up the least.

3. A red yarn strand provided at a tension of 10 grams. White yarn strand provided at a tension of 60 grams and blue yarn strand provided at a tension of 30 grams. The eye might see a three ply yarn that is predominantly red with white showing up the least.

The controller 64 or other controller can assist in varying the tension applicator(s) 70,72 to selectively provide at least one of a plurality of preselected tensions based on a pattern. An electronic program could provide for length of each of the above segments or others such as one having a length of 20 inches, a second segment having a length of 100 inches of different coring level, a third segment having a length of 1000 inches having a coring level which is different from the second segment, but possibly the same or different as the first segment. Finally a fourth segment could have a fourth coring level which is different from the coring level of the third segment, but could be similar or dissimilar to the coring level of either of the first and second segments. Patterns may or may not repeat and can be as long as desired. Some pattern repeats may occur over a thousand or more inches. The program received by the controller 64 preferably elicits signals to the tension applicators 70,72 applied to one or more colors for a certain time and/or length to produce a desired yarn pattern for the segments.

Figure 3:
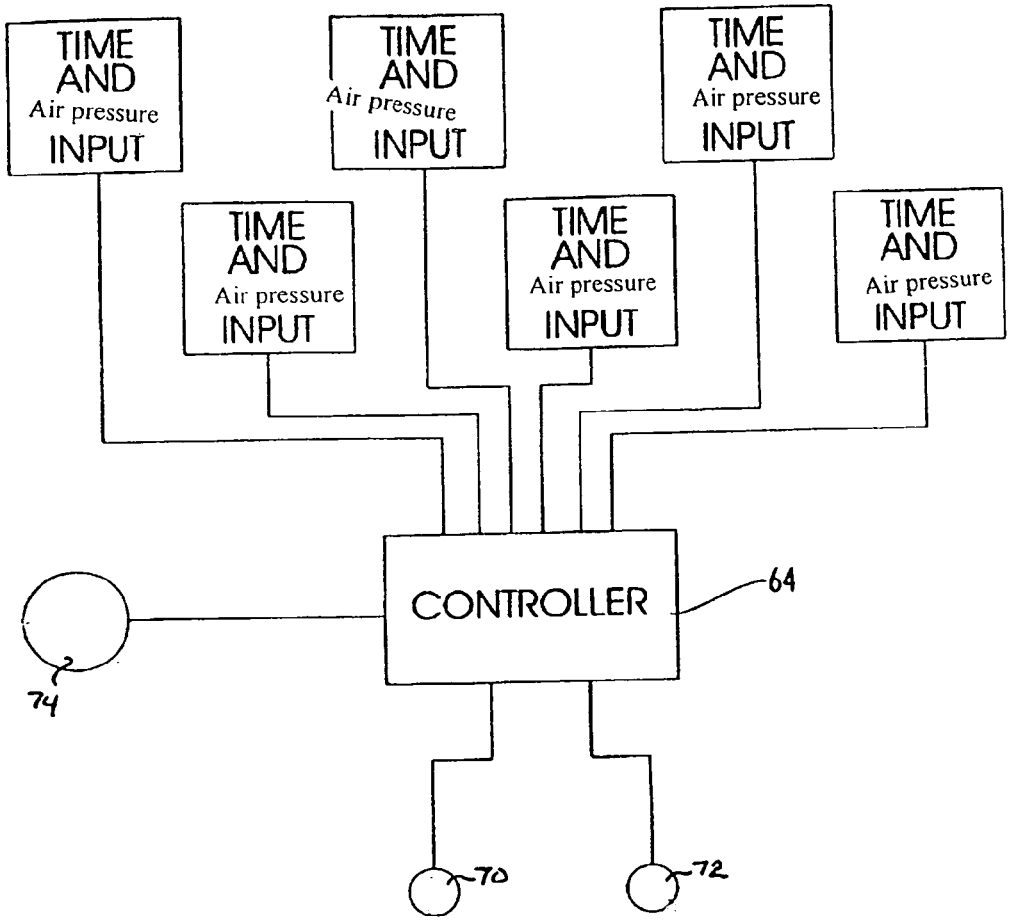
FIG. 3 is an flow diagram for the control of tension for yarn strands fed to a yarn twisting apparatus of the presently preferred embodiment of the present invention.

As illustrated in FIG. 3 with regard to a pattern having six coring segments, the controller 64 may receive a programmed input relative of the tension at which each tension applicator to be applied for a given period of time for each segment of the pattern. The number of segments of coring level in the yarn before a repeat of the pattern is, of course, the length of the pattern. This information may then be directed by the controller to the respective output channel of the controller. Thus, at any particular time in the pattern the tension applicators will be providing or removing a desired tension on yarn 14 relative to yarn 16 and will preferably do so for the required time. Feed-back signals from tension sensor 74 to the controller 64 may ensure that the tension applicator 72 is operating relative to the yarn 14 to provide the required tension to provide a desired coring level called for by the pattern.

Figure 2:
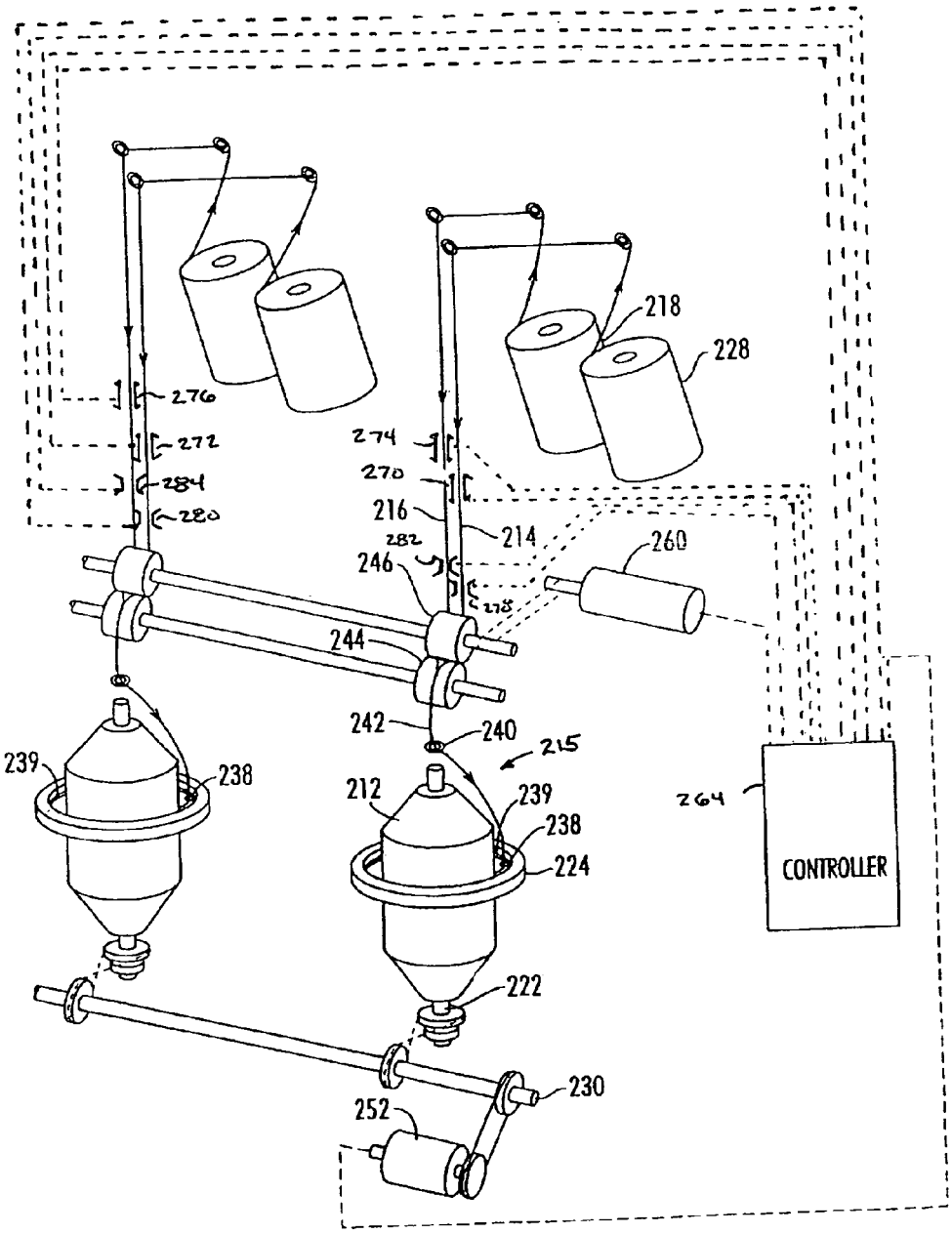
FIG. 2 is a view similar to FIG. 1 but for a ring twisting method of twisting two yarns together incorporating principles of a present embodiment of the present invention.

As it relates to FIG. 3, the tension applicator 70,72 represented could also be tension applicator 270,274 in FIG. 2 and/or other tension applicators. Time and air pressure output is utilized with the illustrated embodiment pattern. Other relationships such as length, time, tension, air pressure, and/or other factors could be utilized in other embodiments to provide pattern information possibly in combination with motor speeds if twist level were to be changed. One or more twisted yarn pairs 242 may be controlled with controller 64, and even more than two yarns can be twisted together in a desired pattern for at least some embodiments. For such a controller, a first signal or no signal could be provided from controller 264 to a tension applicator 270 to provide a different tension than is provided from tension applicator 274, etc., for particular segments of twisted yarn 242.

Motors 52,60 may be servo motors, which is the preferred embodiment of the invention. Controller 64 may be a conventional microprocessor-based programmable industrial controller such as those marketed by Giddings & Lewis of Fond du Lac, Wis., U.S.A. under the trademark PiC900. This controller provides motion control of servo motors and valves or drives in a simple manner such that it is readily usable with the twisting system of the present invention. A RAM (random access memory) disk may store data for the pattern selection. At each instant of the pattern the controller 64 may instruct each servo controlled valve to provide a desired air pressure to the tension applicator to provide a desired tension to yarn 14 in accordance with the level called for by the pattern. Spindle 22 rotates at the required speed and so does the take-up roll 46.

The information input to the controller 64 may be dependent upon information calculated to determine the speed, yarn length and/or times based on the pattern. These calculations may be based on the desired coring level in the pattern and the length of the twist segment such as in inches, meters or portions thereof. The run time in seconds may be related to a multiple of these values. Controller 64 may, or may not, control both twist level and coring level.

The pattern may, for example, begin with 33 inches of a coring level of 0.03, 37 inches of a coring level of −0.5, 41 inches of a coring level of 0.01, 29 inches of a coring level of 0, five inches of a coring level of −0.001, etc. The tension applied may be selected or calculated and the run time determined so as to provide these values, and the controller may drive the motors and/or tension applicators for the selected times accordingly. Should it be desired to use controllable a.c. motors rather than servo motors, a programmable controller such as those sold under the trademark PROSEC T1 such as the T1-28 distributed by Toshiba Corporation, Industrial Division located in Houston, Tex., may be selected as the controller 64.

Thus, the output of the controller 64, utilizing the programmed information and the feedback from the tension sensor(s) 74 controls for the tension applicators 70,72 for the programmed coring level for the appropriate time and/or length programmed into the controller. A finished entangled yarn is thus wound upon the product package rolls 18 having the desired variability.

Thus, a twisting system with an entangler of the cabling type having programmable yarn coring levels in accordance to provide or remove a desired amount of tension with the present invention has been disclosed. The invention may also be applied to other entanglement system, including, but not limited to, a ring twisting system as illustrated in FIG. 2, or a two-for-one twisting system, or other twister based system. Air entanglement equipment and/or air twist equipment also known as reverse twist equipment could be employed as entanglers in still other embodiments.

In a ring twister, as illustrated in FIG. 2, both supply packages 218,228 are mounted on a creel or the like and the two yarns 214,216 are fed together by feed rolls 244,246, the rolls being driven by a motor 260 in the same manner as in the other embodiments, the motor 260 being substantially identical to the motor 60. The yarn 242 leaving the nip between the rolls 244, 246 are directed through an eyelet or ring 240 to a traverse ring 238 which is disposed within a slot 239 in a fixed annular ring 224, the traverse ring 238 being constrained by but movable within the slot. The main motor 252, which may be substantially identical to the motor 52, rotatably drives the drive shaft 230 in the same manner as in the first and second embodiments and the drive shaft 230 rotatably drives a spindle 222, again in the same manner as in the first and second embodiment. In this case, however, the core of the product yarn package or bobbin 212 is rotatably fastened to the spindle 222. The traverse ring 238 rotates or traverses about the yarn package or bobbin as constrained by the slot 239 within which it is mounted due to the pulling action of the rotating bobbin. This results in the two yarns 214, 216 being twisted together and the speed of the yarn being fed to the ring 238 effects the number of twists per unit of length of the yarn 242. Accordingly, by controlling the speed ratio between the feed rolls 244,246 by means of the motor 260, relative to the spindle 222 which, of course, is dependent upon the speed of the motor 252, a twist level may be varied in accordance with the pattern input into the controller 264, the latter possibly being substantially identical to the controller 64 in the other illustrated embodiments. This describes controlling twist level which is optional for many embodiments. Coring level control is described below.

The embodiment of FIG. 2 may be easier for one skilled in the art to see how tension adjusters 270,272 which are individually applied to yarn 214 prior to twisting can be combined with tension adjusters 274,276 so that selective application to tension to one or both strands 214,216 can be provided or released so that coring of one of the yarns relative to the other can occur at the twister 215. Of course, more than two yarns 214,216 can be similarly or dissimilarly treated with other embodiments. Tension sensors 278,280,282,284 may provide feed back to controller 264 after controller 264 provides a signal to one or more of the various tension adjusters 270, 272,274,276. Tension adjusters 270,272,274,276 may be controlled such as by a servo control valve which selectively allows one or more air pressures to be provided to a bladder arrangement which exerts a varying pressure against the yarn 214,216 based on the air pressure provided by the bladder. Other tension mechanisms may be operated in different manners. Pattern may be based on coring level directly or indirectly such as by relating to air pressure and/or tension, etc. Furthermore, depending on the sophistication of a particular tension of this mechanism, it may be relatively instantly adjustable from one applied tension to another or a transition may occur related to tension amounts depending on the operation of a particular tension adjuster 270,272,274,276.

The tension adjusters 270,272,274,276 may apply a desired amount of tension such as 10 grams, 30 grams, 60 grams or more so one yarn (defined to include cabled, etc.) is preferentially cored relative to another cable a desired amount with that amount being expressed in a coring level amount or a differing lengths amount or other factor which would vary with the coring level.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method for entangling at least two yarn strands together into a finished entangled yarn product having a coring level selectively varied along the length of the entangled yarn product in accordance with a preselected pattern, said method comprising:

providing a supply of said yarn strands, an entangler, and a controller at least assisting in imparting said pattern, and entangling said yarn strands together with the entangler to provide a supply of said finished entangled yarn while controllably applying a first predetermined tension differential to at least one yarn relative to another of the at least two yarn strands under the direction of the controller to provide a first coring level not equal to zero for a first selected segment thereby providing a first length of finished entangled yarn product, and then applying a second predetermined tension differential to the at least one yarn relative to the another of the at least two yarn strands under the direction of the controller to provide a second coring level for a second selected segment thereby providing a second length of finished entangled yarn product; wherein said second coring level is not equal to said first coring level and the first and second lengths are provided as the supply of said finished entangled yarn.

2. The method of claim 1 wherein the controller is a programmable controller, and further comprising the step of providing data to the controller which at least assists in providing the pattern.

3. The method of claim 1 further comprising the step of varying the twist level in accordance with a pattern while twisting the yarn strands together.

4. The method of claim 1 wherein during the step of applying the first predetermined tension differential, the controller at least assists in performing the step of at least one of applying and releasing a selected tension to one of the at least two yarn strands with a tension applicator.

5. The method of claim 4 wherein the selected tension is related to an air pressure provided to the tension applicator while providing the first predetermined tension differential.

6. The method of claim 5 wherein the controller provides a signal to control the air pressure provided to the tension applicator.

7. The method of claim 1 wherein the entangler is one of a twister, an air entangler, and an air twister which entangles the yarn strands in the entangle step.

8. An apparatus for entangling at least two yarn strands together into a finished twisted yarn having a coring level selectively varied for selective lengths of said finished yarn in accordance with a preselected pattern, said apparatus comprising:

a first supply yarn and at least a second supply yarn;

an entangler; and a controller in communication with at least one tension applicator;

wherein while the entangler entangles the first supply yarn with the at least a second supply yarn to provide a supply of said finished entangled yarn, the controller controllably applies with at least one tension applicator a first predetermined tension differential to the first supply yarn relative to the at least a second supply yarn to provide a first coring level not equal to zero for a first selected segment thereby providing a first length of finished entangled yarn product, and then applying a second predetermined tension differential to the at least one yarn relative to the another of the at least two yarn strands under the direction of the controller to provide a second coring level for a second selected segment to provide a second length of finished entangled yarn product; wherein said second coring level is not equal to said first coring level and the first and second lengths are provided to the supply of said finished entangled yarn.

9. The apparatus of claim 8 wherein a first of the at least one tension applicator is in communication with the first supply yarn fed to the entangler.

10. The apparatus of claim 9 further comprising a tension sensor sensing the tension of the first supply yarn intermediate the tension applicator and the entangler and providing a feedback signal to the controller.

11. The apparatus of claim 9 wherein the tension applicator is in communication with an air supply and the controller selectively changes at least one air pressure to the tension applicator upon receipt of a signal from the controller.

12. The apparatus of claim 9 wherein the at least one tension applicator further comprises a second tension applicator in communication with the second supply yarn.

13. The apparatus of claim 12 wherein the controller is in communication with the first and second tension applicators and selectively imparts the pattern through the first and second tension applicators.

14. The apparatus of claim 13 wherein the supply of said finished twisted yarn is provided to a yarn package.

15. The apparatus of claim 8 wherein the controller is a programmable controller.

16. The apparatus of claim 8 wherein the entangler is a twister configured to selectively vary a twist level of yarn and the finished entangled yarn has third and fourth lengths having two different twist levels.

17. The apparatus of claim 16 wherein the twist level is provided by the pattern provided by the controller.

18. The apparatus of claim 8 wherein the entangler is one of a twister, an air entangler, and an air twister.

* * * * *